United States Patent [19]

Caldwell et al.

[11] Patent Number: 4,666,765

[45] Date of Patent: May 19, 1987

[54] SILICONE COATED FABRIC

[76] Inventors: James M. Caldwell, Escondido; Michael R. Lubitz, Encinitas; Eric J. Ruston, Cardiff, all of Calif.

[21] Appl. No.: 782,962

[22] Filed: Oct. 2, 1985

[51] Int. Cl.[4] ..... B05D 1/36; B05D 3/12; B32B 7/00; B32B 17/02

[52] U.S. Cl. ..... 428/266; 427/358; 427/381; 427/387; 427/407.3; 428/447; 428/448; 428/268

[58] Field of Search ..... 427/358, 407.3, 381, 427/387; 428/429, 447, 448, 266, 268

[56] References Cited

U.S. PATENT DOCUMENTS 4,472,470 9/1984 Modic ..... 427/407.3 X
4,474,860 10/1984 Van Gilder et al. ..... 427/358 X
4,478,895 10/1984 Makami et al. ..... 427/407.3
4,500,584 2/1985 Modic ..... 427/407.3 X

*Primary Examiner*—Michael R. Lusignan
*Attorney, Agent, or Firm*—Spensley Horn Jubas & Lubitz

[57] ABSTRACT

The present invention is directed to method for making silconecoated woven fabric substrates, and the products produced by such method. The method comprises the steps of applying a first liquid polysilicane elastomer to the substrate so as to form a base coat, curing the base coat, applying a second liquid polysilicane elastomer over the base coat so as to form a top coat, and curing the top coat. By specifically selecting the polysilicane elastomers as well as the substrate, and by further selecting the reaction parameters, a high strength, nonflammable, waterproof, self-cleaning, translucent and weather-resistant fabric is produced.

16 Claims, No Drawings

SILICONE COATED FABRIC

BACKGROUND OF THE INVENTION

1. Field of Invention

The present invention relates to the field of fabrics for use in architectural fabric structures. In particular, the present invention relates to a high-strength, non-flammable, waterproof, self-cleaning translucent and weather resistant woven fabric for use in manufacturing architectural structures.

2. Description of the Prior Art

Architectural fabrics have been used to make a wide range of structures. For example, large, permanent roofing systems have been constructed of thick, durable fabric held in place under tension. In the past, the architectural fabric structure business has depended to a large extent on fabric made of fiberglass cloth coated with polytetafluoroethylene (e.g. TEFLON). However, Teflon-coated fabric has many disadvantages and limitations. These include the fact that the overall longevity and tensile strength of Teflon-coated fabrics is poor, and such fabrics are generally very rigid and unpliable. As a result, Teflon-coated fabrics are difficult to work with. Further, Teflon-coated fabrics are very opaque, or have very low levels of light translucency. This limits their utility in many architectural structures. Moreover, Teflon-coated fabrics are not as "self-cleaning" as desired in the industry, soil easily, and thus make them aesthetically unattractive after a short period of use.

Some of the above-noted problems are discussed in U.S. Pat. Nos. 4,472,470 and 3,436,366, the disclosures of which are herein incorporated by reference. As noted in the '470 patent, a roofing structure is disclosed, comprising a base fabric material, a base coating and a silicone top coat. However, the transparent membrane fabric described in patent '470 has several critical flaws. One is that the silicone rubber coating burns readily. This problem can be overcome by loading the rubber with inorganic fillers, but this causes the material to lose its transparency. The flammability of the transparent membrane material precludes its use for fabric structures intented to shelter human beings.

The question of transparency concerns more than the rubber itself. The substrate on to which the rubber is coated can block out a significant percentage of the solar radiation incident upon the fabric. For example, when heavy fiberglass cloth (breaking strength greater than 600 pounds per linear inch) is used as a substrate for transparent rubber, solar transmittance is reduced by 70%. Thus even a transparent coating does not assure a transparent membrane. It is a goal of this patent to provide a silicone coated fabric with increased solar transmittance, high strength, and flame retardancy. The combination of these properties in a single fabric represents a significant advance over the prior art. Additionally, it is an object of this patent to provide a methodology for coating said fabric. The methodology incorporated herein is necessary to insure good adhesion of the rubber to the substrate, an issue not previously addressed in the art.

SUMMARY OF THE INVENTION

The present invention is concerned with a process for manufacturing an architectural fabric having a breaking strength of greater than 600 pounds per linear inch. In particular, the invention comprises a woven substrate coated with a liquid silicone elastomer formulation (SLE) and top coated with another silicone liquid elastomer formulation (SLE'). In the preferred embodiment of the invention, the base coat SLE is modified with a small amount of $Al(OH)_3$, which renders the resultant product noncombustible, and has the additional benefit of increasing the percent solar transmittance of the fabric.

Prior to coating, the substrate is cleaned and finished with a coupling agent to promote adhesion of the silicone rubber coating to the substrate. The coatings are applied by a dip coat/drag knife process, and the coated substrate is cured at elevated temperatures. The resulting silicone coated woven substrate is non-flammable, flexible, self-cleaning, impervious to weathering and allows sufficient light transmittance to promote the growth of grass underneath a roof of said fabric.

DESCRIPTION OF THE PREFERRED EMBODIMENT

The following description is made for the purpose of illustrating the general principles of the invention and is not to be taken in a limiting sense. The scope of the invention is best determined by reference to the appended claims.

A. The Substrate

The coatings of the present invention can be used on a variety of fabric substrates, so long as the base coating is able to penetrate or "wet" the fabric. For architectural structures, the preferred woven substrate fabric is similar to the conventional fiberglass support used for making surf boards and the like. A fabric known in the industry as style 7544 is an example of a suitable preferred woven fiberglass fabric substrate. Style 7544 fiberglass fabric is characterized as an ECG glass basket weave having a construction of $28 \times 14$ yarns per inch, a weight of 7500 yards per pound, a warp ply of 2/2, a fill ply of 2/4, and a thickness of 22 mils. Other woven fabrics are also within the scope of this invention, e.g., cotton, polyester and nylon.

The performance of a fiberglass finished product depends to a certain extent on the ability of the base coating to penetrate the weave of the fabric and coat the individual glass fibers. This helps prevent those fibers from "cutting" themselves upon subsequent flexing of the fabric. For this reason, woven fiberglass substrates are preferably heat cleaned and treated with a silane or suitable finish. Cleaning the glass fiber fabric is of special importance in those cases where the fabric has been "treated" with a coating which prevents the base coat from thoroughly coating the fibers. If the fabric is not cleaned first (before applying the silane finish), subsequent application of the silane often times does not yield a fabric having all the desirable properties for use as an architectural fabric. It is believed that poor results are due to water which may become trapped in the fabric. Water can then hydrolyze the bond between the SLE and the glass fiber resulting in a loss of adhesion. HEXCEL CO. 7544 is marketed with a silane finish designated by HEXCEL CO. under the trademark "F-72". This finish functions to increase the critical surface tension of the fiberglass fibers, imparting better wet-in. In addition, the silane finish acts as a coupling agent between the silicone liquid elastomer (SLE) formulation base coating and the fiberglass fibers thereby to increase adhesion.

Coupling agents, which are used in the present invention to coat the cleaned fibers are well-known in the art. Silane coupling agents which are characterized as a silicon atom bonded to three hydrolyzable groups are well known in the art. One example is set forth below:

$$H_2C{=}C{-}Si{-}(OCH_2)_3$$

A particular finish can be tested for effectiveness by the following simple test.

A sample of the glass fiber is coated with a base coat in such a way that it soaks in the SLE a standardized period of time before curing. The sample is then cured and allowed to cool. The sample is then hung in a 0.2N aqueous solution of boiling potassium permanganate and allowed to boil for one hour. The sample is removed and the glass fibers are examined microscopically. If the coupling agent is effective in promoting wet-in and adhesion of the SLE rubber to the glass, the purple potassium permanganate solution will not penetrate the fibers and stain them purple. A large degree of purpleness in the fibers in the area of fabric that was above the boiling solution indicates that the coupling agent was not effective.

One primary goal of the invention is to provide a fabric which allows enough light transmittance to promote the growth of grass under a structure. It is known among Botonists that a light transmittance of about 45% is needed to promote grass growth. Light transmittance is measured in ASTM E 424-71 "Solar Energy Transmittance and Reflectance of Sheet Materials." In the test, a light source generates light of varying wavelengths. The sample is placed across the beam of light, and a detector measures the amount of light that continues to pass through the sample. The percent transmittance is calculated relative to air at sea level. For our use, the percent transmittance was measured in the visible region only, because the growth of grass depends on light in this region. DSET conducted the testing. They tested a fabric sample consisting of the transparent silicone rubber coated on to style 7544 fiberglass cloth and obtained a transmittance of 34%. Higher transmittance could be achieved with a more open scrim fiberglass, however, 7544 was chosen because of high breaking strength. A sample of the same rubber plus 3 parts per weight $Al(OH)_3$ per 100 parts per weight rubber was tested, and it was discovered that light transmittance has increased to 42%. The result was surprising because the addition of the $Al(OH)_3$ introduced a milky appearance to the previously clear rubber. We surmise that the microcrystalline nature of the $Al(OH)_3$ makes it easier for light to pass through the fabric. We liken the effect to the phenomenon sometimes seen on hazy days, where light from the sun becomes very bright, and can be painful to the eyes.

The addition of $Al(OH)_3$ to the rubber has the additional advantage that it causes the rubber to become fire-retardant. When ignited, the rubber will not continue to burn after the flame is removed. The combination of high solar transmittance and good flame retardancy is a significant advance in the art.

B. The Base Coating

The silicone liquid elastomer (SLE) base coating of the fabric substrate preferably has a high tear strength of about 60 pounds per inch or more and comprises, by weight:

(1) about 100 parts of a liquid vinyl chain-stopped polysiloxane having the formula:

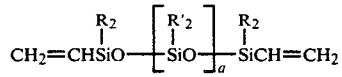

where R and R′ are monovalent hydrocarbon radicals free of aliphatic unsaturation with at least 50 mole percent of the R′ groups being methyl and where "a" has a value sufficient to provide a fluid material having a viscosity of from about 50,000 to 750,000 centistokes at 25° C.;

(2) from about 20 to about 50 parts of an organopolysiloxane copolymer comprising trimethylsiloxane units, methylvinylsiloxane units, and $SiO_2$ units, and where from about 2.5 to about 10 mole percent of the silicon atoms contain silicon bonded vinyl groups and where the ratio of trimethylsiloxane units to the $SiO_2$ units is between 0.5:1 to 1:1;

(3) from 0 to about 200 parts of a finely divided inorganic filler or pigment to give the base coating color and which is non-reinforcing for silicone elastomers;

(4) a platinum catalyst; and (5) an amount of a liquid organohydrogenpolysiloxane having a formula:

$$(R)_b(H)_cSiO_{4-b-c/2}$$

sufficient to provide from about 0.5 to 1.0 silicon bonded hydrogen atoms per silicon-bonded vinyl group in the composition, where R is as previously defined, "b" has a value of from 1.00 to 2.10, "c" has a value of 2.00 to 2.67, there being at least two silicon-bonded hydrogen atoms per molecule.

(6) An amount of finely divided aluminum hydroxide to provide about 3/10 parts by weight per 100 parts of ingredients 1–5 inclusive.

The General Electric Company markets products under the trademarks "SLE 5300", "SLE 5500" and "SLE 5100" which fall within the base coating formulation set forth by ingredients 1–5 above.

C. The Top Coating

The silicone liquid elastomer (SLE′) top coating of the fabric substrate is a formulation comprising:

(1) a liquid vinyl chain-stopped polysiloxane having the formula,

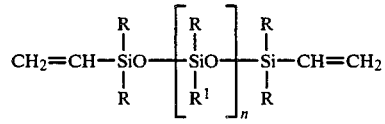

where R and $R^1$ are monovalent hydrocarbon radicals free of aliphatic unsaturation with at least 50 mole percent of the $R^1$ groups being methyl, and where "n" has a value sufficient to provide a viscosity up to about 1,000 centipoise at 25° C.;

(2) a resinous organopolysiloxane copolymer comprising:

(1) $(R^2)_3SiO_{0.5}$ units and $SiO_2$ units, (2) $(R^3)_3SiO_{0.5}$ units, and $(R^3)_2SiO$ units and $SiO_2$ units, or (3) mixtures thereof, where $R^2$ and $R^3$ are selected from the group comprising vinyl radicals and monovalent hydrocarbon radicals free of aliphatic unsaturation, where from about 1.5 to about 10 mole percent of the silicon atoms contain silicon-bonded vinyl groups, where the ratio of monofunctional units to tetrafunctional units is from about 0.5:1 to about 1:1, and wherein the ratios of difunctional units to tetrafunctional units ranges up to about 0.1:1;

(3) a platinum or platinum containing catalyst; and (4) a liquid organohydrogenpolysiloxane having the formula:

$$(R)_b(H)_cSiO_{4-b-c/2}$$

sufficient to provide from about 0.5 to about 1.0 silicon-bonded hydrogen atoms per silicon-bonded vinyl group, R is a monovalent hydrocarbon radical free to aliphatic unsaturation, "d" has a value of from about 0.1 to about 1.0, and the sum of "d" and "e" is from about 2.0 to about 2.7, there being at least two silicon-bonded hydrogen atoms per molecule. While a wide range of proportions of various ingredients to make the top coat are within the scope of the invention, those proportions taught by the '470 patent are preferred, i.e., where the vinyl chain-stopped polysiloxane ranges from 300 to 500 cps at 25° C., and where there is present from about 0.75 to about 1.25 parts by weight resinous organopolysiloxane copolymer per 100 parts by weight vinyl chain-stopped polysiloxane.

(5) a solvent to provide from 0 to 200 parts by weight solvent per 100 parts of ingredients 1–4 inclusive.

Preferably the top coating is the product sold by the General Electric Company under the trademark "SLE 5106A" which is catalyzed 10:1 with G.E. "SLE 5106B". In the present invention, the top coat is applied in a solvent dispersion system, using tolulene or xylene 10 to 100% by weight, in order to obtain a smooth uniform coat.

D. The Process

The process of the present invention utilized a dip-coat/drag knife process, such as is well known in the art. In such process, one utilizes dipping vats, doctoring blades or drag knives and a curing oven.

In the preferred embodiment, the fabric substrate, for example, HEXCEL 7544 or some other woven substrate, is utilized. As noted above, such fabric is treated, after it is cleaned, with a silane to increase the adhesion of the SLE base coat. Prior cleaning of the woven substrate represents one of the differences between the present invention over that taught in the '470 patent. Further, if the substrate is covered with loose yarn, these are removed prior to coating, as jamming of the spreader and uneven coating can result.

The cleaned and silane treated fabric is first dipped into a vat of the SLE base coating material. The base coating taught in the '470 patent and preferrably General Electric Company SLE 5300A, SLE 5500A or mixtures, preferably 1:1, are used as the SLE base coating. In preparing the base coating, the ingredients may be mixed at the time of dipping or may be primed and kept under conditions which inhibit curing, such as low temperatures.

Since the SLE base coating is a highly viscous material, it is necessary to use a special pumping system to mix the catalyst into the base rubber in the proper weight ratio. This is accomplished in the present invention through the use of a special high viscosity pump. The pump forces catalyst and base rubber out of their containers in separate streams and in a predetermined volume ratio. In this case the catalyst refers to the cross-linking agent, which is stored separately from the other components. The two materials are directed into a manifold which combines the two streams into one. In this manner, the catalyst is added at the last possible movement. The materials are then mixed by a "static mixer", a convoluted metal device which introduces turbulence into the stream. The static mixer is located at the output nozzles, again encouraging the reaction at the last possible time. In the present invention, a Grayco "Hydra-Mate" air driven pump and static mixer are used. From there, the catalyzed mixture is directed into a coating trough. Because the catalyst is added to the SLE base coat at the last moment, shock stratification, i.e., coagulation of the rubber into globs is substantially precluded.

The woven substrate is then dipped into a vat or other suitable container filled with the SLE base coating and is allowed to soak up the silicone liquid elastomer. Because the SLE base coat has a relatively high viscosity, 50,000 to 200,000 cps., it is necessary to allow the rubber to soak into the substrate for about one minute before vulcanization. This soak time is somewhat critical. If the rubber is not permitted to penetrate the substrate, the substrate will be degraded due to self-abrading. If the soak time is too long, the fibers of the substrate become locked in place and tearing of the final product can occur much more readily.

The substrate is then urged between oppositely disposed doctoring blades or drag knives which smooth the SLE base coating and maintain the thickness of coating to a desired thickness. If a fiberglass substrate is used, the drag knives are set on a thickness of about 2–10 mils thicker than the substrate thickness, depending on the coating speed, to yield a base coat thickness of approximately 3–12 mils thicker than the substrate thickness. This unusually thick coating is necessary to hide the numerous tiny flaws in fiberglass woven material. Flame singeing of the fiberglass to remove some of the hairs poking out of the glass may also be utilized. It may also be preferable to use a wiper system of a flexible adhesive sheeting to brush off stray hairs clinging to the fabric. This is also helpful in reducing flaws.

The SLE base coated substrate is then heated in an oven to effect curing. The oven temperature for the SLE base coat can be varied, depending on how long the substrate takes to make its way through the oven. The cure is fairly forgiving, i.e., it is satisfactorily cured over a wide range of temperatures. The SLE base coat, for example, can be cured at 400° F. for two minutes. However, longer cure times at lower temperatures will also give good results. Preferably, the temperatures of the oven should be 150° F. to approximately 450° F.

Another important aspect of the present invention is that the top coat is maintained at a low temperature. As the coated substrate leaves the oven, and plunges into the top coat bath it is approximately 400° F. It has been found desirable to cool the top coat bath to 150° F. or lower to help prevent the hot fabric from any hot spots which may be in the substrate from burning or melting through the top coat, or from causing the top coat to prematurely catalyze and gel in the bath.

The cured SLE base coated substrate is dipped into a vat or other suitable container containing the SLE' top coating formulation. Such SLE' top coating formulations are also set forth in the '470 patent. Preferably, the SLE' is applied as a xylene dispersion.

Once the fabric substrate is coated with the SLE' top coating, the substrate is urged through another set of doctoring blades which smooth out the coating and maintain a desired thickness. For, the SLE' top coat fiberglass is maintained at about 1.5 mil on each side of the substrate. The SLE' top coated fabric is then heated in an oven, preferably to about 400° F. for about one minute, to effect curing. Since the top coat is applied with a solvent, it is desirable to initially begin cure at about 120°–180° F., drive off the solvent and then further heat the substrate to about 370°–410° F. Direct heat to 400° F. can result in the cure taking place so fast that combustion can occur.

The cure temperature of the top coating, in contrast with the base coating, must be closely watched. Temperatures of less than 380° F. may result in tackiness of the SLE' top coating. This is highly undesirable for a dirt resistant fabric. Tackiness of the top coating should thus also be monitored during the coating process.

The fabric substrate is now ready for use, as the top coat is now cured to a non-tacky, dirt resistant coating on both sides of the substrate.

The two coated fabric can be coated or laminated to a different film or substrate to reflect or absorb or trap infrared rays, while permitting natural light to pass through.

The silicone coated fiberglass fabric made in accordance with the methodology of the present invention is soft and pliable to the touch and is very easy to form into many desirable shapes, while not sacrificing the overall tensile strength of the fabric. Further, fabric is very durable, does not degenerate under ultra violet rays to the same extent as many prior art fabrics, and has a minimum life cycle of 20+ years. Further still, the finished fabric is self-cleaning and weather resistant, and therefore can be used under many adverse climates and locations. In addition to these benefits, the forementioned properties of high strength, flame retardancy, and solar transmittance levels of greater than 42% have not been seen in the prior art.

As is apparent from the above, this invention may be modified without departing from its true spirit and scope. Thus, other changes are also within the scope of the present invention.

What is claimed is:

1. A method for making a translucent, weather-resistant, fire-retardant, silcone coated woven fabric substrate comprising the steps of:

(a) applying a high tear strength composition comprising a first translucent silicone liquid elastomer and aluminum hydroxide, to a clean, woven, translucent substrate;

(b) allowing the first silicone liquid elastomer to penetrate the substrate and thereby form a translucent base coating on the translucent substrate;

(c) passing the translucent base coated substrate through first fashioning means for controlling the thickness of the base coating;

(d) allowing the base coating to cure;

(e) applying a second translucent silicone liquid elastomer to the cured translucent base coated substrate thereby forming a translucent top coating, said second silicone liquid elastomer being applied at a temperature of less than about 150° F.;

(f) passing the top coated substrate resulting from step (e) through second fashioning means for controlling the thickness of the top coating; and (g) curing the top coating, whereby, a translucent, fire retardant, woven fabric substrate is produced.

2. The method of claim 1 wherein the base coating formed in step (c) has a thickness of about 3–10 mils thicker than the substrate.

3. The method of claim 2 wherein the top coating formed in step (f) has a thickness of about 1.5 mils.

4. The method of claim 1 wherein the base coating is produced by immersing the substrate into a formulation comprising, by weight:

(1) about 100 parts of a liquid vinyl chain-stopped polysiloxane having the formula:

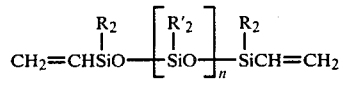

where R and R' are monovalent hydrocarbon radicals free of aliphatic unsaturation, with at least 50 mole percent of the R' groups being methyl and where n has a value sufficient to provide a viscosity of from about 50,000 to 750,000 centistrokes at 25° C.;

(2) from about 20 to about 50 parts of an organopolysiloxane copolymer comprising trimethylsiloxane units, methylvinylsiloxane units, and $SiO_2$ units and where from about 2.5 to 10 mole percent of the silicon atoms contain silicon bonded vinyl groups and where the ratio of trimethylsiloxane units to the $SiO_2$ units is between 0.5:1 and 1:1, (3) a platinum-containing catalyst;

(4) an amount of a liquid organohydrogenpolysiloxane having the formula:

$$(R)_b(H)_cSiO_{4-b-c/2}$$

sufficient to provide from about 0.5 to 1.0 silicon-bonded hydrogen atoms per silicon-bonded vinyl group in the compositions, where b has a value of from 1.00 to 2.1, c has a value of from about 0.1 to 1.0, and the sum of b and c is from about 2.00 to 2.67, there being at least two silicon-bonded hydrogen atoms per molecule;

(5) from about 0.3 to 100 parts per weight of finely divided aluminum hydroxide per 100 parts of the base coating ingredients 1–4 above inclusive;

and the top coating is produced by immersing the base coated substrate into a formulation comprising:

(1) a liquid vinyl chain-stopped polysiloxane having the formula where m has a value sufficient to provide a viscosity up to about 1,000 centipose at 25° C.;

(2) a resinous organopolysiloxane copolymer comprising:

(i) $(R^2)_3SiO_{0.5}$ units and $SiO_2$ units, (ii) $(R^2)_3SiO_{0.5}$ units, $(R^3)_2SiO_2$ units and $SiO_2$ units, or (iii) mixtures thereof, where $R^2$ and $R^3$ are selected from the group consisting of vinyl radicals and monovalent hydrocarbon radicals and monovalent hydrocarbon radicals free of aliphatic unsaturation, where from about 1.5 to about 10 mole percent of the silicone atoms contain silicon-bonded vinyl groups, where the ratio of monofunctional units to tetrafunctional units is from about 0.5:1 to about 1:1, and the ratios of difunctional units to tetrafunctional units ranges up to about 0.1:1;

(3) a platinum-containing catalyst;

(4) a liquid organohydrogenpolysiloxane having the formula:

$$(R^4)_d(H)_eSiO_{4-d-e/2}$$

sufficient to provide from about 0.5 to about 1.0 silicon-bonded hydrogen atoms per silicon-bonded vinyl group, $R^4$ is a monovalent hydrocarbon radical free to aliphatic unsaturation, "d" has a value of from about 1.0 to about 2.1, "e" has a value of from about 0.1 to about 1.0, and the sum of "d" and "e" is from about 2.0 to about 2.7, there being at least two silicon-bonded hydrogen atoms per molecule; and (5) from 0 to 200 parts by weight solvent per 100 parts of the top coating ingredients 1–4 above, inclusive.

5. The method of claim 1 wherein said base coat is cured in step (d) at a temperature of about 400° F. and is then cooled to a temperature of below about 100° F. in step (e).

6. The method of claim 4 wherein said base coating is applied as a bath and the ingredients (1), (2) and (4) of the base coating are mixed together prior to the addition of the catalyst (3).

7. A product produced according to the method of claim 1.

8. A product produced according to the method of claim 4.

9. A product produced according to claim 4 wherein the platinum-containing catalyst is a platinumolefinic hydrocarbon complex obtained from the reaction of a platinum halide and an olefinic hydrocarbon selected from the group consisting of styrene and ring substitued styrenes in the presence of a basic material.

10. A method for making a translucent, weather-resistant, fire retardant, silcone coated architectural fabric substrate comprising the steps of:

(a) applying a coating composition comprising a first translucent liquid polysiloxane elastomer and aluminum hydroxide, to a translucent silane-treated woven glass substrate so as to form a translucent base coating of about 3–10 mils in thickness;

(b) curing said base coating;

(c) applying a second translucent liquid polysiloxane elastomer, which is resistant to dirt pickup, at a temperature of about 50° F. to about 100° F. over said translucent base coating so as to form a translucent top coating; and (d) curing said translucent top coating.

11. The method of claim 10 wherein said substrate is a woven glass cloth which has been cleaned prior to applying the silane finish.

12. The method of claim 10 where said first polysiloxane is produced by immersing the substrate into a formulation comprising, by weight:

(1) about 100 parts of a liquid vinyl chain-stopped polysiloxane having the formula:

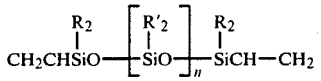

where R and R′ are monovalent hydrocarbon radicals free of aliphatic unsaturation, with at least 50 mole percent of the R′ groups being methyl and where n has a value sufficient to provide a viscosity of from about 50,000 to 750,000 centistrokes at 25° C., (2) from about 20 to about 50 parts of an organopolysiloxane copolymer comprising trimethylsiloxane units, methylvinylsiloxane units, and $SiO_2$ units and where from about 2.5 to 10 mole percent of the silicon atoms contain silicon bonded vinyl groups and where the ratio of trimethylsiloxane units to the $SiO_2$ units is between 0.5:1 and 1:1;

(3) a platinum-containing catalyst; and (4) an amount of a liquid organohydrogenpolysiloxane having the formula:

$$(R)_b(H)_cSiO_{4-b-c/2}$$

sufficient to provide from about 0.5 to 1.0 silicon-bonded hydrogen atoms per silicon-bonded vinyl group in the compositions, where b has a value of from 1.00 to 2.1, c has a value of from about 0.1 to 1.0, and the sum of b and c is from about 2.00 to 2.67, there being at least two silicon-bonded hydrogen atoms per molecule;

(5) from about 0.3 to 100 parts per weight of finely divided aluminum hydroxide per 100 parts of the base coating ingredients 1–4 above inclusive;

and the top coating is produced by immersing the base coated substrate into a formulation comprising:

(1) a liquid vinyl chain-stopped polysiloxane having the formula where m has a value sufficient to provide a viscosity up to about 1,000 centipose at 25° C., (2) a resinous organopolysiloxane copolymer comprising:

(i) $(R^2)_3SiO_{0.5}$ units and $SiO_2$ units, (ii) $(R^2)_3SiO_{0.5}$ units, $(R^3)_2SiO_2$ units and $SiO_2$ units, or (iii) mixtures thereof, where $R^2$ and $R^3$ are selected from the group consisting of vinyl radicals and monovalent hydrocarbon radicals and monovalent hydrocarbon radicals free of aliphatic unsaturation, where from about 1.5 to about 10 mole percent of the silicone atoms contain silicon-bonded vinyl groups, where the ratio of monofunctional units to tetrafunctional units is from about 0.5:1 to about 1:1, and the ratios of difunctional units to tetrafunctional units ranges up to about 0.1:1;

(3) a platinum-containing catalyst, and (4) a liquid organohydrogenpolysiloxane having the formula:

$$(R^4)_d(H)_eSiO_{4-d-e/2}$$

sufficient to provide from about 0.5 to about 1.0 silicon-bonded hydrogen atoms per silicon-bonded vinyl group, $R^4$ is a monovalent hydrocarbon radical free to aliphatic unsaturation, "d" has a value of from about 1.0 to about 2.1, "e" has a value of from about 0.1 to about 1.0, and the sum of "d" and "e" is from about 2.0 to about 2.7, there being at least two silicon-bonded hydrogen atoms per molecule.

13. The method of claim 12 wherein said base coating is applied as a bath and the ingredients (1) (2) and (3) of the base coating are mixed together prior to the addition of the organohydrogen polysiloxane (4).

14. The method of claim 12 when said second liquid polysiloxane is applied at a temperature of about 50° F.

15. A product produced by the method of claim 11.

16. A product produced by the method of claim 14.

* * * * *